US008177572B2

(12) United States Patent
Feye-Hohmann

(10) Patent No.: US 8,177,572 B2
(45) **Date of Patent: *May 15, 2012**

(54) ELECTRIC CONNECTION DEVICE

(75) Inventor: Jürgen Feye-Hohmann, Detmold (DE)

(73) Assignee: Phoenix Contact GmbH & Co., Blomberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/240,191

(22) Filed: Sep. 22, 2011

(65) Prior Publication Data

US 2012/0028513 A1 Feb. 2, 2012

(51) Int. Cl.
*H01R 11/22* (2006.01)

(52) U.S. Cl. ..... 439/268

(58) Field of Classification Search ..... 439/268, 439/839, 849, 850, 852, 854, 862
See application file for complete search history.

(56) References Cited

U.S. PATENT DOCUMENTS

| | | | | |
|---|---|---|---|---|
| 3,937,548 | A * | 2/1976 | Dittmann | 439/436 |
| 4,217,021 | A * | 8/1980 | Illum | 439/787 |
| 4,701,000 | A | 10/1987 | Suprono | |
| 5,569,892 | A * | 10/1996 | Shiga et al. | 200/19.36 |
| 6,443,757 | B1 * | 9/2002 | Martinez | 439/441 |
| 7,491,101 | B2 * | 2/2009 | Irish et al. | 439/853 |
| 8,052,447 | B2 * | 11/2011 | Feye-Hohmann | 439/268 |
| 2002/0022412 | A1 | 2/2002 | Alonson Merino et al. | |
| 2002/0076998 | A1 | 6/2002 | Feye-Homann | |
| 2005/0085139 | A1 | 4/2005 | Copper et al. | |
| 2010/0267292 | A1 | 10/2010 | Pueschner et al. | |

FOREIGN PATENT DOCUMENTS

| | | |
|---|---|---|
| DE | 198 33 610 | 8/1999 |
| DE | 101 52 520 | 5/2003 |
| DE | 102 30 367 | 1/2004 |
| DE | 2004 000 418 | 7/2005 |
| DE | 10 2005 053 566 | 5/2007 |
| EP | 1 622 223 | 2/2006 |
| EP | 1 783 868 | 5/2007 |
| GB | 2 294 817 | 5/1996 |
| WO | WO 2010/006758 | 1/2010 |

* cited by examiner

*Primary Examiner* — Tulsidas C Patel
*Assistant Examiner* — Phuongchi Nguyen
(74) *Attorney, Agent, or Firm* — Greer, Burns & Crain, Ltd.

(57) ABSTRACT

An electric connection device for connecting a conductor having at least one contact bush of a conductive material with a clearing for a contact spring and a contact spring disposed thereat which clamps a conductor plugged into the contact bush from a plug-in side against the inner wall of the contact bush wherein the contact spring is pivotable outwardly through the clearing.

16 Claims, 5 Drawing Sheets

ELECTRIC CONNECTION DEVICE

PRIORITY CLAIM

Applicant claims priority benefits under 35 U.S.C. §120 on the basis of patent application Ser. No. 13/002,579, filed Jun. 15, 2011, which claims priority from PCT/EP2009/005104, filed Jul. 14, 2009.

BACKGROUND

The present invention relates to an electric connection device and in particular an electric terminal for connecting an electric conductor. The electric connection device according to the invention may in particular also be suitable for connecting a plurality of electric conductors.

In the prior art, electric connection devices and electric terminals have become known which are suitable for connecting one or more electric conductors. Most of these electric terminals are manufactured from components made by way of stamping and bending wherein first a base plate is punched out which is then bent over along the provided bending edges. The contact spring is made from a bending portion of the base plate and bent into the clamping zone for the conductor to be connected to clamp a conductor to be connected against the clamping zone of the electric terminal.

The drawback of the known prior art is that the basic shape of the components made by way of stamping and bending is substantially angular so as to limit the packing density in case of multiple terminals to be arranged adjacent side by side.

Another drawback of the known prior art is that as a rule it is not possible to provide a linear configuration of the conductor to be connected and the connected contact element since due to the bent shape of the electric terminal a directional offset is present at least in one direction.

SUMMARY

Against the background of the known prior art it is therefore the object of the present invention to provide an electric connection device and in particular an electric terminal for connecting a conductor allowing a high packing density and enabling a linear arrangement.

The inventive electric connection device for connecting a conductor comprises at least one contact bush of an electrically conductive material wherein the contact bush is provided with a clearing or recess for a contact spring. The clearing has disposed at it a contact spring for clamping a conductor plugged into the contact bush from a plug-in side against an inner wall of the contact bush. The contact spring may be pivoted outwardly through the clearing or it is pivotally disposed thereat such that, as a conductor to be connected is plugged in the contact spring pivots outwardly by the corresponding conductor cross-section while a corresponding clamping force is applied to the conductor.

The electric connection device according to the invention has many advantages. A considerable advantage of the electric connection device according to the invention is that employing a contact bush allows to provide a particularly compact electric terminal which allows a clearly higher packing density on a base area than do known electric connection devices.

It is another considerable advantage of the inventive electric connection device that the contact bush allows a linear connection of the conductor to be connected and of a connected contact element. The conductor to be connected is linearly plugged into the contact bush from the plug-in side where it is clamped against the inner wall of the contact bush in the zone of the clamping point and at the opposite end of the contact bush a contact element may be provided arranged linear thereto so as to allow an overall axially symmetric structure.

In a particularly preferred more specific embodiment the contact bush is rotationally symmetrical in cross-section at least in one place. The contact bush is in particular manufactured from a turned component such that the base component of the contact bush is entirely rotationally symmetrical in shape prior to the finishing process. Using such a contact bush allows a particularly compact structure of the electric terminal and a space-saving arrangement of multiple connection zones for connecting multiple conductors to one connection device.

In particularly preferred configurations the connected contact element is oriented linear to the contact bush. In the case of a linear arrangement of the contact bush and the contact element the space required in the plane perpendicular to the connecting direction is particularly small so as to allow a particularly high packing density.

Basically it is possible to employ for a contact element any desired type of electric contact element by means of which the electric connection device can be connected to another component. It is for example preferred to employ a round, flat, or flattened contact pin which is placed onto or inserted into a lower slotted bush portion of the contact bush. It is also possible to employ other contact elements for connecting the electric connection device for example to a circuit board.

In all of the configurations and more specific embodiments the contact bush preferably comprises a central receiving opening for receiving a conductor wherein in particular the diameter of the receiving opening is adapted to the cross-section of the conductor to be received such that only a narrow gap remains. This allows to obtain a particular high packing density of conductors to be connected.

It is particularly preferred for the contact spring to be a separate component clamping a conductor to be connected against an inner wall of the contact bush. In particular does the contact spring comprise an attachment portion and at least one spring portion with the contact spring with the attachment portion preferably surrounding the contact bush at least in part. The spring portion extends from the attachment portion directly or indirectly in the direction of the clamping point where the spring portion clamps a plugged-in conductor against the inner wall of the contact bush.

In particularly preferred more specific embodiments the attachment portion is configured annular and may comprise a slot at one point. By way of the annular attachment portion the contact spring is pushed in particular onto or over the end of the contact bush on the plug-in side where it snaps in particular into a peripheral groove of the contact bush so as to obtain a firm seat of the contact spring in respect of the contact bush in the axial direction.

In a preferred more specific embodiment the contact bush comprises in the clamping zone a transverse opening transverse to the longitudinal extension of the in particular cylindrical receiving opening. A clamping edge of the contact spring cooperates with the transverse opening for clamping a conductor to be plugged in.

The clamping edge is in particular configured straight, linearly clamping the conductor to be connected or its conductor wires into the transverse opening. The transverse opening preferably extends in the clamping zone of the conductor to be plugged in transverse to the plug-in direction.

By means of the transverse opening a defined depression is provided at the preferably cylindrical receiving opening allowing to provide a straight clamping edge at the contact spring which also reliably clamps a wire bunch of multiple fine conductor wires in a defined way. Due to a straight clamping edge a conductor having a plurality of conductor wires does not fan out but all of the conductor wires are pushed straight into the clamping bush.

The transverse opening allows the conductor wires to be pressed in by means of the contact spring such that the conductor wires may be slightly buckled in the region of the transverse opening since in this position the clamping edge of the contact spring pushes the conductor wires into the transverse opening configured as a transverse bore, transverse groove, or e.g. notching.

Small burrs tend to form at the transverse opening having the additional positive feature of increasing the friction coefficient both for large and small wires.

The contact spring is preferably configured at least in part of a material having good or even excellent resilience properties. Employing a non-conductive material is in particular likewise conceivable. This allows to employ inexpensive materials and on the whole better cost-efficiency in manufacturing the electric connection device. The contact spring may consist e.g. of spring steel and in particular of a non-corroding spring steel, of bronze or spring bronze or the like.

The end of the contact bush opposite the plug-in end is in particular slotted to facilitate placement onto a contact pin.

In all of the above described configurations and more specific embodiments of the electric connection device according to the invention a releasing device for releasing the clamp of the contact spring is preferably provided to facilitate removal of a connected conductor as needed. In all of the configurations it is preferred for the contact spring when clamped to be at an acute angle to the insertion direction of a conductor to be connected. In these cases, pulling at the conductor will further increase the clamping force because a directional lock is present. Now for removing the conductor when required the releasing device may be employed which can be actuated by way of an operating device thus releasing the clamp on the conductor to the inner wall of the contact bush.

In preferred embodiments the releasing device abuts the contact bush, being surrounded by the contact bush and the contact spring. At least the attachment portion of the contact spring surrounds the releasing device.

The releasing device may be provided with a conical insertion ring to facilitate inserting a conductor into the contact bush.

Furthermore the releasing device may be provided with at least one engagement element which when the releasing device has been inserted into the contact bush causes engagement with the contact bush or with the contact spring such that although the releasing device is axially displaceable by a specific distance in particular for releasing the clamp it can no longer be readily taken off the contact bush.

Preferably the contact bush is treated in an area on the plug-in side so as to provide a semi-cylinder. Another, abutting semi-cylinder or the like is provided by a portion of the releasing device so as to result in a central cylindrical insertion opening for a conductor to be connected. The contact bush shaped semi-cylindrically on the insertion side and the releasing device shaped semi-cylindrically in this spot together form a ring surrounded by the attachment portion of the contact spring.

By way of axial movement of the releasing device the releasing device is displaced along the contact bush which is shaped for example semi-cylindrically until a portion of the releasing device hits against the spring portion of the contact spring thus pivoting the contact spring outwardly as movement continues, thus canceling the clamping force.

In another preferred more specific embodiment multiple cylindrical contact bushes are disposed adjacent to receive one conductor each. What is particularly preferred is an arrangement according to the "5" on a dice wherein four cylindrical contact bushes are disposed at the corners of a rectangle, and one contact bush centrally in the middle of the rectangle. A diagonal diameter through three contact bushes is smaller than four times the smallest diameter of one single contact bush.

These dimensions follow among other things from the fact that when using a rectangular contact bush the diagonal diameter of one single contact bush equals approximately 1.4 times the minimum diameter. Now, with three of these quadratic contact bushes being arranged diagonally, then the diagonal is a minimum of approximately 4.2 times the minimum diameter of one single contact bush.

Due to using cylindrical contact bushes the minimum diameter of one contact bush directly corresponds to the maximum diameter of one contact bush so as to allow to arrange three contact bushes diagonally wherein the total dimension is smaller than 4 times the diameter of one single contact bush. Given these dimensions, a certain distance between contact bushes is conceivable and preferred.

In all of the configurations one side of the contact bush may be provided with an operating surface of the releasing device which is for example suitable to receive a screwdriver for operating the releasing device. Resetting the releasing device to its home position is as a rule achieved by the contact spring which as the screwdriver is removed pushes the releasing device back to the home position.

In all of the configurations it is preferred for the contact bush to be of brass or of copper or the like. Other metals may be employed as well. The contact spring may consist of metal but it may as well be manufactured of plastic. The releasing device is preferably manufactured of plastic.

Another electric connection device according to the invention comprises at least one contact bush of a conductive material and provided thereat a receiving opening for a conductor to be plugged in. The contact bush has a clamping groove configured at the contact bush transverse to the plug-in direction of the conductor.

This electric connection device according to the invention again has considerable advantages. The clamping groove is preferably provided at a transverse opening extending in particular in the clamping zone of the conductor to be plugged in transverse to the plug-in direction. By means of the transverse opening a defined clamping groove forms at the preferably cylindrical receiving opening where the cylindrical receiving opening comprises a defined depression. This allows to insert at the contact spring a clamping edge configured straight allowing defined and reliable clamping also of a wire bunch of multiple fine conductor wires at the clamping groove. A conductor having a plurality of conductor wires does not fan out but is pushed straight into the clamping groove in the clamping zone of the cylindrical receiving opening.

The clamping groove is preferably formed by a transverse bore or a transverse groove and interacts with the clamping edge at the tip of the contact spring. The clamping edge at the tip of the spring portion of the contact spring is preferably straight. The clamping edge is biased to the engagement position by the contact spring.

BRIEF DESCRIPTION OF THE DRAWINGS

Further advantages and features of the present invention follow from the embodiments which will be explained below with reference to the attached figures.

The figures show in.

DETAILED DESCRIPTION

Figure 1:
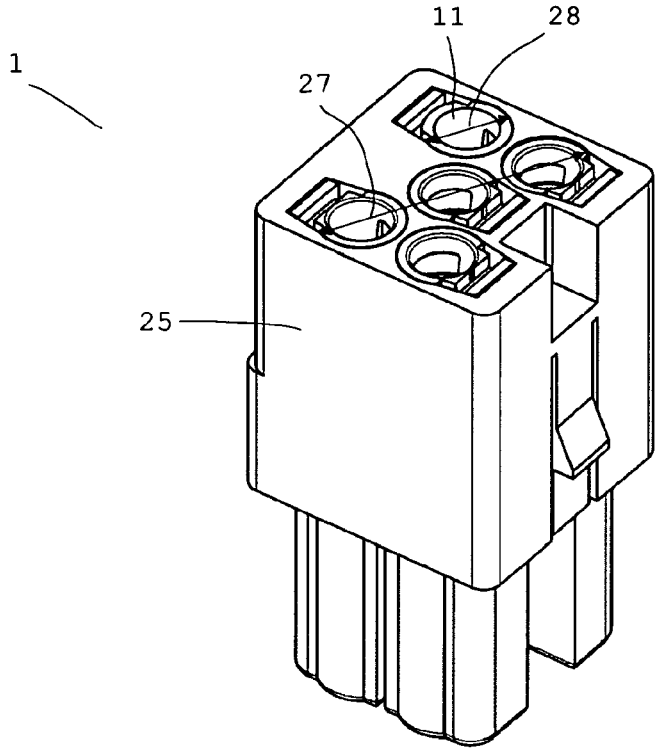
FIG. 1 a perspective overall view of an electric terminal according to the invention.

With reference to the FIGS. 1 to 6 a first embodiment of the present invention will be described below with FIG. 1 illustrating a perspective overall view of an electric terminal 1 or an electric connection device.

The electric terminal 1 illustrated in FIG. 1 comprises a housing 25 on the top face of which five receiving openings 11 are disposed. Four openings for inserting and connecting electric conductors 2 (see FIG. 3) are disposed on a rectangular or quadratic base area while the fifth opening is provided in the center of the square. Due to this, a diagonal has three insertion openings 11 disposed on it wherein a diagonal diameter 27 across the three insertion openings 11 is only slightly larger than three times the diameter of a diagonal 28 of one single insertion opening 11. Presently this is possible in that the insertion openings and the contact bushes 3 disposed beneath are configured circular or cylindrical.

Figure 2:
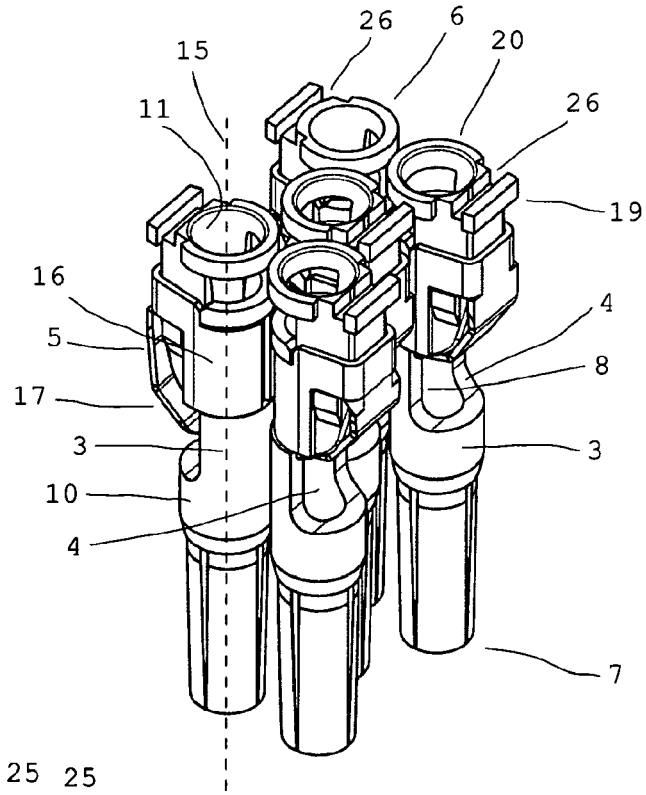
FIG. 2 the electric terminal of FIG. 1 minus the housing.

In FIG. 2 the electric terminal of FIG. 1 is illustrated minus the surrounding housing 25 so as to show the individual contact bushes 3. In the plane of the top edge of the housing 25 a high packing density of the conductors to be connected is present the increase of which was possible due to the specific configuration of the individual contact bushes 3.

Figure 5:
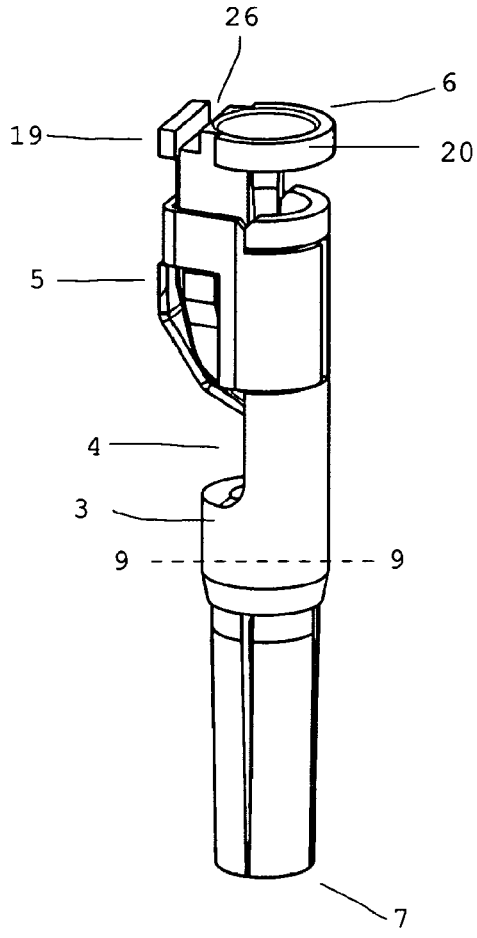
FIG. 5 one single contact bush with a contact spring and releasing device.
Figure 6:
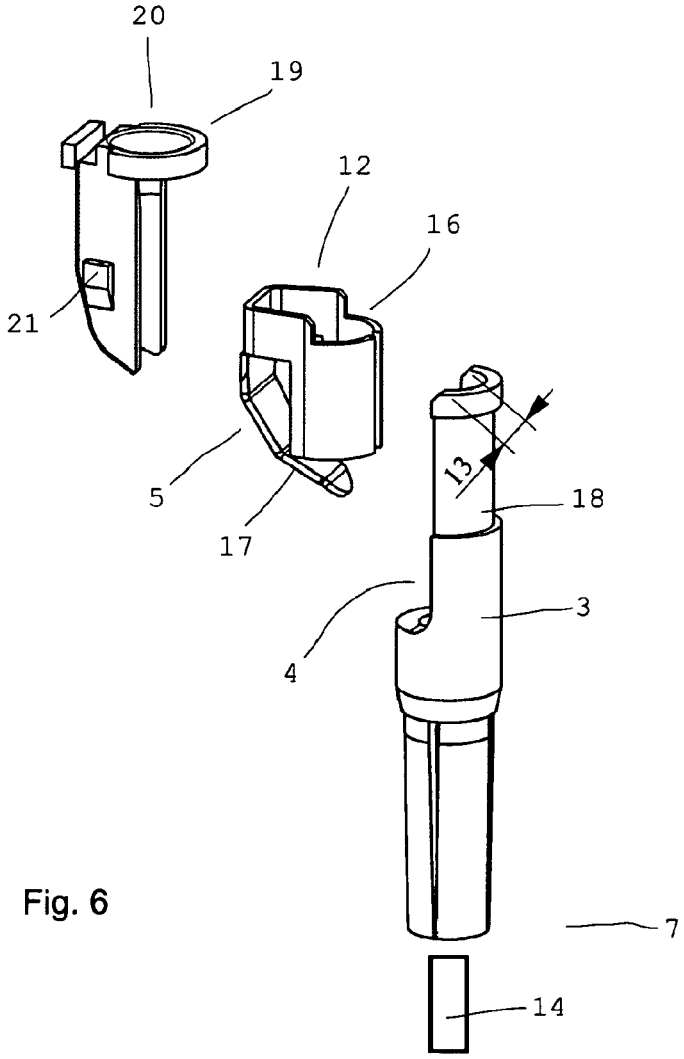
FIG. 6 an exploded view of the contact bush with a contact spring and a releasing device.

A contact bush 3 with a contact spring 5 mounted thereon and a releasing device 19 is illustrated separately in FIG. 5. FIG. 6 illustrates a perspective exploded view of the contact bush 3 of the contact spring 5 and the releasing device 19.

FIG. 6 clearly shows that the contact bush 3 which was first configured as a cylindrical turned component, comprises a recess or clearing 4 in a region on the plug-in side 6 where presently a semi-cylindrical portion of the contact bush was removed as a clearing 4 such that the contact bush 3 is now only configured as a semi-cylindrical component on the plug-in side 6.

In the vicinity of the end on the plug-in side 6 a groove 18 is provided on the outer periphery of the contact bush 3 into which when assembled an attachment portion 16 of the contact spring 5 configured as a separate spring component 12 engages.

A spring portion 17 of the contact spring 5 serves to clamp a pushed-in conductor 2 against the inner wall 8 (see in particular the FIGS. 3 and 4) in the region of the clearing. The attachment portion 16 of the contact spring 5 may be configured as a continuous ring or else as shown in FIG. 6 it may be slotted on the side opposite the spring portion 17 to facilitate placement on the contact bush 3.

Prior to or optionally subsequent to mounting the contact spring 5 the releasing device 19 is mounted. When mounted the releasing device 19 extends between the contact spring 5 and the contact bush 3. The lengthwise webs of the releasing device 19 abut the contact bush 3 that is configured semi-cylindrical in the region of the clearing 4. The releasing device 19 is displaceable in the longitudinal direction of the contact bush 3 relative to the contact bush 3. The engagement elements 21 on both sides of the releasing device 19 prevent the releasing device 19 from inadvertently falling out of the terminal 1.

At the end opposite the plug-in side 6 or on the connection side 7 a printed circuit board or the like may be contacted via a contact pin 14. It is a considerable advantage of the terminal 1 according to the invention that a linear cable routing of the conductor to be connected 2 to the contact pin 14 or to another contact element is possible. On the whole a terminal 1 is possible that is compact both in the attachment surface and on the whole.

The releasing device 19 may be provided with an insertion ring that is configured in particular conical to facilitate insertion of an electric conductor 2. The conductor enters the contact bush through the clear diameter 13 at the contact bush 3, slightly pivoting the spring portion 17 of the contact spring outwardly while being pushed in. An insertion ring or insertion funnel may alternatively be formed by the housing.

One of the considerable advantages of the present terminal 1 is that not only connecting conductors having multiple conductor wires is possible but so is connecting solid conductors. Solid conductors can be inserted directly without operating the key button or the releasing device 19.

The releasing device 19 may be provided with an operating groove 26 suitable to apply a tool 22 to (see FIG. 4) so as to axially displace the releasing device 19 in the longitudinal direction of the contact bush 3 by pressing against the operating groove 26. The releasing device 19 meets the spring portion 17 of the contact spring 5, urging the spring portion 17 of the contact spring outwardly such that a conductor 2 received at the contact bush 3 can be removed.

As shown in FIG. 2, a linear connection of a conductor is possible along an axis 15 from the plug-in side 6 as far as the opposite connection side 7.

The connections of the terminal disposed closely adjacent are arranged in pairs with the operating grooves 26 showing outwardly so as to achieve high packing density on the whole.

Figure 3:
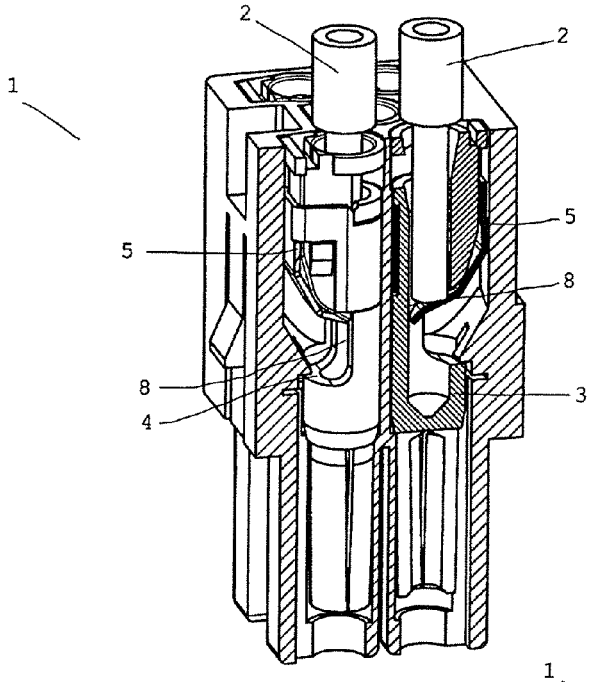
FIG. 3 a sectional perspective side view of the terminal according to FIG. 1.

FIG. 3 shows how a conductor 2 is inserted into the terminal according to the invention, opening the contact spring 5 such that the conductor 2 can be clamped against the inner wall 8 of the contact bush 3.

The contact spring 5 or its spring portion 17 enters into the clearing 4 of the contact bush 3 from the outside.

Figure 4:
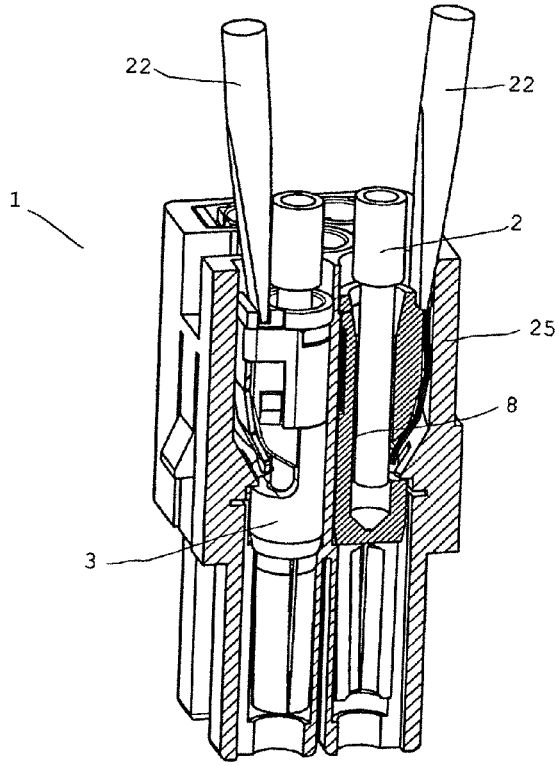
FIG. 4 a sectional side view with a tool applied for releasing the clamp.

As shown in FIG. 4, operating by a tool 22 which is inserted into the operating groove 26 of the releasing device 19 causes the releasing device 19 to be axially displaced in the direction of the longitudinal extension of the contact bush 3. The releasing device 19 meets the spring portion 17 of the contact spring 5, pivoting the spring portion 17 outwardly by means of a tool 22 penetrating further so as to undo the clamp.

On the whole an electric terminal 1 is obtained that is flexible in structure and requires little space. The contact spring 5 is configured as a separate spring component 12 and thus may be comprised of another material having good resilience properties which is not required to have good electric conductive properties though.

This allows to decrease manufacturing costs and increase reliability. The terminal according to the invention can be employed both with conductors with multiple conductor wires and for connecting solid conductors so as to achieve a flexible range of application.

Figure 7:
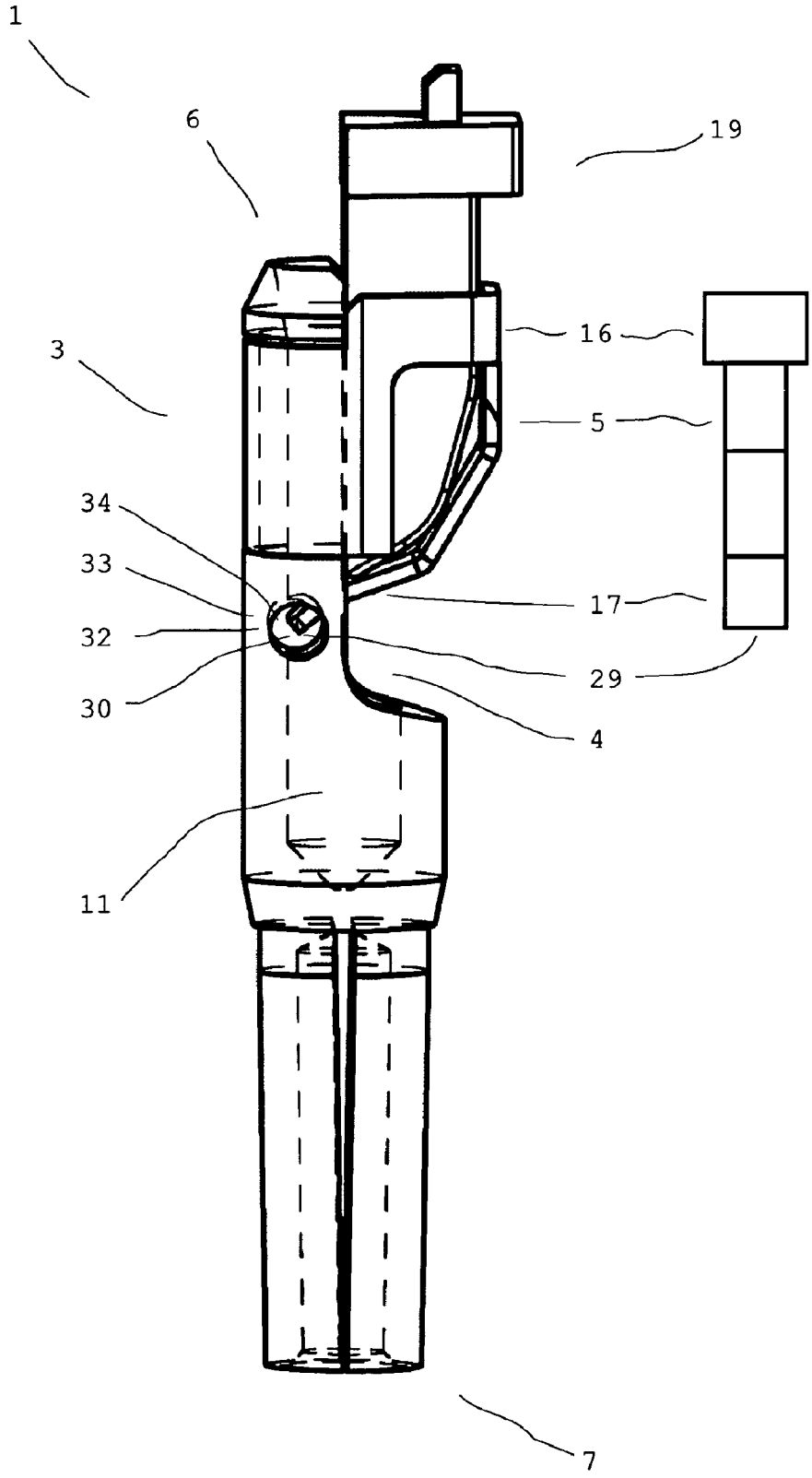
FIG. 7 another embodiment of a contact bush with a contact spring and a releasing device.

With reference to FIG. 7 another embodiment will now be discussed, and thereafter with reference to the FIGS. 8 to 10, another embodiment of inventive electric terminals 1. Like or similar components are provided with the same reference numerals.

FIG. 7 illustrates an electric terminal 1. In the embodiment according to FIG. 7 the clamping zone 33 of the contact bush 3 is provided with a transverse opening 32 configured as a transverse bore 30 such that in that cylindrical receiving opening 11 a transverse groove 31 is formed which serves as a clamping groove 34.

The transverse opening 32 in the clamping zone 33 of the contact bush 3 is oriented transverse to the longitudinal extension of the cylindrical receiving opening 11. A clamping edge 29 of the contact spring 5 cooperates with the clamping groove 34 for clamping a conductor 2 to be plugged in.

In the top area of FIG. 7 to the right of the electric terminal 1 a schematic side view of a contact spring 5 is illustrated. It is clearly recognizable in the schematic side view that the bottom end of the spring portion 17 of the contact spring 5 is configured straight such that by way of the straight clamping edge the conductor 2 to be clamped is linearly pushed into the clamping groove 34 of the receiving opening 11.

The invisible edges of the receiving opening 11 are shown in FIG. 7 in dashed lines. It can clearly be seen that the clamping groove 34 stands back radially.

The clamping edge 29 in the present embodiment is configured straight while in the preceding embodiments it was provided rounded to match the cylindrical receiving opening 11. The clamping edge 29 configured straight presently linearly clamps the conductor 2 to be connected or its conductor wires into the transverse opening 32.

By means of the transverse bore 30 a defined depression or clamping groove 34 is provided at the cylindrical receiving opening 11 into which a straight clamping edge 29 of the contact spring 5 can plunge. This is why a wire bunch of multiple fine conductor wires is also reliably clamped in a defined way. No fanning out due to a forwardly rounded clamping edge occurs.

The transverse bore 30 allows the conductor wires to be pressed in by means of the contact spring 5 such that the conductor wires may be slightly buckled in the region of the transverse opening 32 since in this position the clamping edge 29 of the contact spring 5 urges the conductor wires into the transverse opening 32 configured as a transverse bore 30, transverse groove 31, or e.g. notching.

In manufacturing, small burrs tend to form at the transverse opening 32 having the additional positive feature of increasing the friction coefficient both for large and small conductors 2 to be plugged in.

Figure 8:
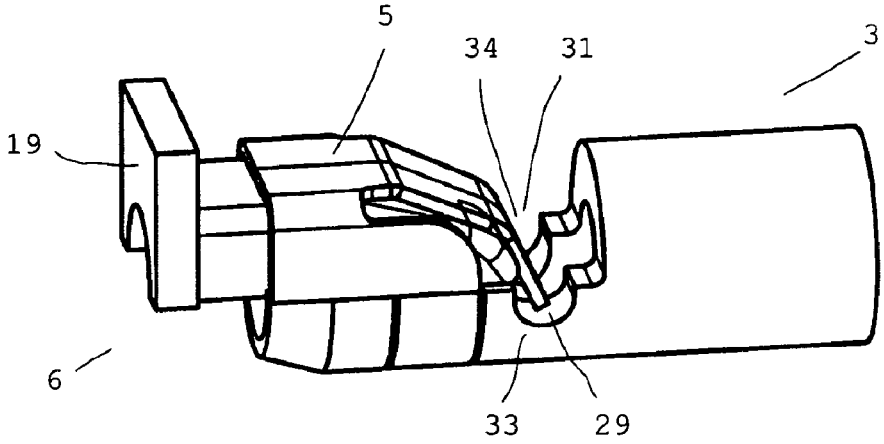
FIG. 8 still another embodiment of a contact bush with a contact spring and a releasing device.
Figure 9:
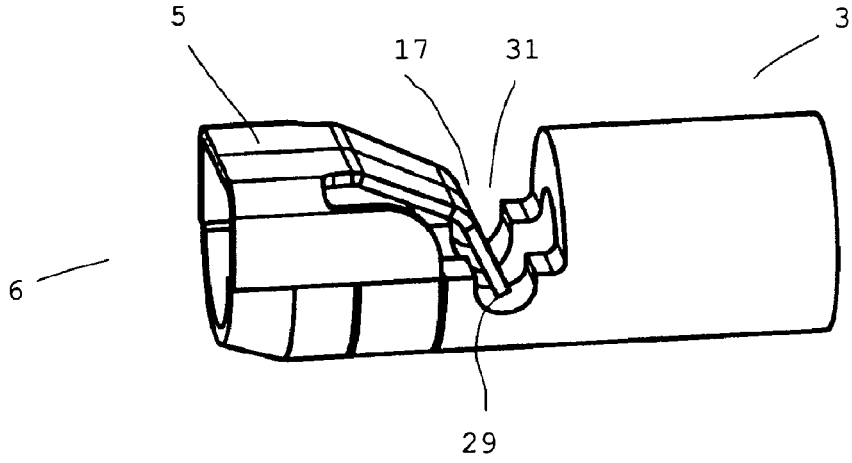
FIG. 9 the contact bush and the contact spring of the embodiment according to FIG. 8.
Figure 10:
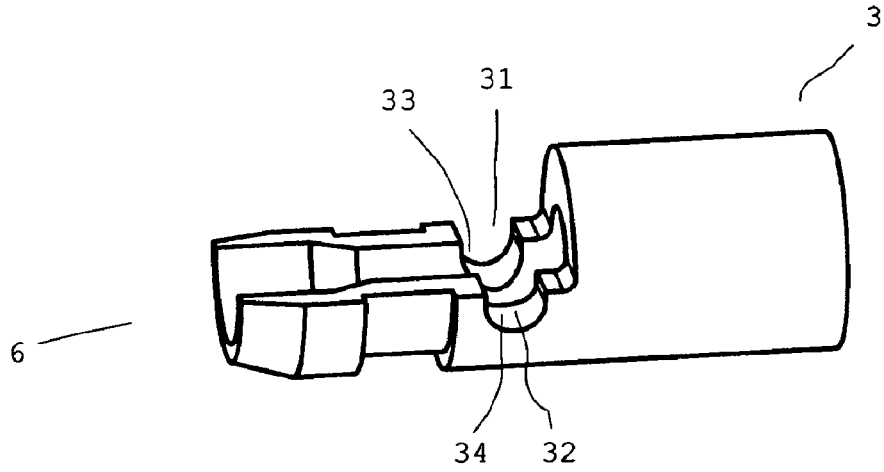
FIG. 10 the contact bush of the embodiment according to FIG. 8.

In the embodiment illustrated in FIGS. 8 to 10 of an electric terminal 1 according to the invention the transverse opening 30 is configured as a transverse groove 31. The transverse groove 31 serves as a clamping groove 34, into which a conductor 2 to be connected or its conductor wires are urged through the contact spring 5.

Again the clamping edge 29 is configured straight since it can plunge into the clamping groove 34 at the lateral rims.

While the contact bush 3 in the embodiment according to FIG. 7 is provided with a transverse bore, a transverse groove 31 is presently provided to provide a clamping groove 34 into which a clamping edge 29 configured straight plunges.

The transverse groove 31 extends transverse to the plug-in direction in the clamping zone 33 of the conductor 2 to be plugged in. By means of the transverse groove 31 a defined clamping groove 34 is provided at the cylindrical receiving opening 11 where the cylindrical receiving opening 11 comprises a defined depression. This allows to insert at the contact spring 5 a clamping edge 29 configured straight allowing defined and reliable clamping at the clamping groove 34 also of a wire bunch of multiple fine conductor wires. A conductor having a plurality of conductor wires does not fan out but is pushed straight into the clamping groove 34 in the clamping zone 33 of the cylindrical receiving opening 11.

As in all of the embodiments, a releasing device 19 may be provided.

LIST OF REFERENCE NUMERALS

1 terminal
2 conductor
3 contact bush
4 clearing
5 contact spring
6 plug-in side
7 end, connection side
8 inner wall
9 position
10 turned component
11 receiving opening
12 spring component
13 diameter
14 contact pin
15 axis
16 attachment portion
17 spring portion
18 groove
19 releasing device
20 insertion ring
21 engagement element
22 tool
25 housing
26 operating groove
27 diagonal diameter
28 diameter
29 clamping edge
30 transverse bore
31 transverse groove
32 transverse opening
33 clamping zone
34 clamping groove

What is claimed is:

1. An electric connection device for connecting a conductor having at least one contact bush of a conductive material with a clearing for a contact spring and a contact spring disposed thereat which clamps a conductor plugged into the contact bush from a plug-in side against an inner wall of the contact bush wherein the contact spring is pivotable outwardly through the clearing;

wherein the contact spring is made of a conductive material and/or non-conductive material at least in part;

further including a releasing device for releasing the clamp of the contact spring; and wherein the releasing device abuts the contact bush and is surrounded by the contact bush and the contact spring.

2. The electric connection device according to claim 1, wherein the contact bush is rotationally symmetric in cross-section at least in one place and is in particular manufactured from a turned component.

3. The electric connection device according to claim 1, wherein a linear arrangement of conductor to be connected and connected contact element is present.

4. The electric connection device according to claim 1, wherein the contact bush comprises a central receiving opening for receiving a conductor wherein the diameter of the receiving opening is matched to a cross-section of the conductor to be received.

5. The electric connection device according to claim 1 wherein the contact bush is configured slotted at one end opposite the plug-in side to facilitate placement onto a contact pin.

6. The electric connection device according to claim 1 wherein the attachment portion of the contact spring is received in a groove of the contact bush.

7. The electric connection device according to claim 1, wherein a conical insertion ring is provided at the releasing device.

8. The electric connection device according to claim 1, wherein at least one engagement element is provided at the releasing device.

9. The electric connection device according to claim 1, wherein the releasing device is semicircular in cross-section to bear against the contact bush.

10. The electric connection device according to claim 1, wherein multiple cylindrical contact bushes are disposed adjacent to receive one conductor each.

11. The electric connection device according to claim 1 wherein four cylindrical contact bushes are disposed at the corners of a rectangle and one contact bush, centrally in the rectangle, wherein a diagonal diameter through three contact bushes is smaller than four times the smallest diameter of one single contact bush.

12. The electric connection device according to claim 1 wherein the contact spring comprises a straight clamping edge and/or wherein the clamping groove is configured at a transverse opening and in particular at a transverse bore or transverse groove.

13. An electric connection device for connecting a conductor, comprising: at least one contact bush of a conductive material with a clearing for a contact spring and a contact spring which clamps a conductor plugged into the contact bush from a plug-in side against a wall of the contact bush, wherein the contact spring is pivotable outwardly through the clearing, the contact spring is a separate component surrounding the contact bush at least in part by an attachment portion and includes a spring portion for clamping the conductor to be connected against the wall of the contact bush, and the contact bush includes a transverse opening transverse to the longitudinal extension of a receiving opening in a clamping zone.

14. The electric connection device of claim 13 further including a clamping edge is located on the contact spring for clamping the conductor to be plugged in.

15. The electric connection device of claim 1 further including one receiving opening for a conductor to be plugged in, and a clamping groove is configured at the contact bush transverse to the plug-in direction of the conductor.

16. The electric connection device of claim 13 further including one receiving opening for a conductor to be plugged in, and a clamping groove is configured at the contact bush transverse to the plug-in direction of the conductor.

* * * * *